US007216734B2

(12) United States Patent
Fujii

(10) Patent No.: US 7,216,734 B2
(45) Date of Patent: May 15, 2007

(54) CONSTRUCTION MACHINE

(75) Inventor: Tokuo Fujii, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 254 days.

(21) Appl. No.: 10/945,028

(22) Filed: Sep. 21, 2004

(65) Prior Publication Data

US 2005/0066556 A1 Mar. 31, 2005

(30) Foreign Application Priority Data

Sep. 25, 2003 (JP) ..... 2003-333567
Sep. 30, 2003 (JP) ..... 2003-341346

(51) Int. Cl.
*B62D 25/10* (2006.01)

(52) U.S. Cl. ..... 180/69.24; 180/69.2

(58) Field of Classification Search ..... 180/69.2, 180/69.24
See application file for complete search history.

(56) References Cited

U.S. PATENT DOCUMENTS 4,221,274 A * 9/1980 Martin, Jr. ..... 180/69.2
4,770,263 A * 9/1988 Yoshioka ..... 180/89.17
4,785,900 A * 11/1988 Nasky ..... 180/89.14
5,351,884 A * 10/1994 Kadotani et al. ..... 237/12.3 A
6,167,976 B1 * 1/2001 O'Neill et al. ..... 180/69.2

FOREIGN PATENT DOCUMENTS

| | | |
|---|---|---|
| JP | 9-195315 | 7/1997 |
| JP | 11-1939 | 1/1999 |
| JP | 2000-96609 | 4/2000 |
| JP | 2001-32327 | 2/2001 |
| JP | 2002-61222 | 2/2002 |
| JP | 2003-74085 | 3/2003 |
| JP | 2003-112579 | 4/2003 |
| JP | 2003-205871 | 7/2003 |

* cited by examiner

*Primary Examiner*—Christopher P. Ellis
*Assistant Examiner*—John R. Olszewski
(74) *Attorney, Agent, or Firm*—Oblon, Spivak, McClelland, Maier & Neustadt, P.C.

(57) ABSTRACT

A construction machine according to the present invention comprises a maintenance opening portion formed extending over a front shielding plate of a seat stand adjacent to a control stand and a side shielding plate of the control stand, or a maintenance opening portion formed extending over the front shielding plate and an upper shielding plate connected to an upper part of the front shielding plate. Further, the construction machine comprises a maintenance cover for closing the opening portion. According to such a structure, workability of the maintenance work of the construction machine can be improved.

12 Claims, 8 Drawing Sheets

CONSTRUCTION MACHINE

BACKGROUND OF THE INVENTION

1. Field of the Invention

The present invention relates to a construction machine such as a hydraulic excavator.

2. Description of the Related Art

In a compact excavator as small construction machine, conventionally, an engine is frequently arranged under an operator's seat in order to make an upper rotating body as compact as possible. However, this leads to the problem that maintenance work of the engine and equipment and devices disposed around it cannot be efficiently performed.

For example, as disclosed in Japanese Patent Application Laid-Open (Kokai) No. 9-195315, a seat stand for supporting the operator's seat is constituted to be a frame, and a cover is mounted on the frame through bolts as fastening means. When this cover is removed to perform the maintenance of the equipment and devices arranged inside the seat stand, the frame becomes an obstacle which prevents a maintenance worker's hand from reaching to the devices, and the maintenance work of the equipment and devices arranged inside the frame cannot be efficiently performed.

In a construction machine disclosed in Japanese Patent Application Laid-Open (Kokai) No. 2001-32327, the top plate of a guard cover having the operator's seat fixed thereto is opened upward, so that maintenance of the engine disposed under the top plate and the equipment and devices disposed around it can be performed. However, such a maintenance work is hard to be done because an operator has to reach out the operator's hands from the upper part of the engine, and the equipment and devices disposed in front of or under the engine are difficult to be reached in their maintenance. Further, since a heater for blowing hot air to the operation space or a duct for sending hot air are disposed around the engine, these hinder the maintenance work to deteriorate the workability of the maintenance work.

SUMMARY OF THE INVENTION

The present invention thus has an object to provide a construction machine capable of improving workability of the maintenance work.

A construction machine according to the present invention has the following basic structure.

Namely, this construction machine comprises an upper shielding plate for shielding an upper part of an engine, a front shielding plate for shielding a front part of the engine, and a side shielding plate for covering devices on the construction machine, the side shielding plate being disposed adjacently to the front shielding plate, wherein a maintenance opening portion is formed extending over between the front shielding plate and one of the side shielding plate and the upper shielding plate. Further, this construction machine comprises a detachable maintenance cover for closing the maintenance opening portion.

In this case, an obstacle such as the frame can be eliminated in the maintenance opening portion to be opened at the time of maintenance. Consequently, the maintenance work through the maintenance opening portion can be performed easily, and the workability of the maintenance work can be improved.

Particularly, when the maintenance opening portion is provided extending over the upper shielding plate and the front shielding plate, the maintenance opening portion can be formed more largely, unlike in case of providing an opening only on the top plate provided above the engine. Therefore, the maintenance work of the engine and devices disposed around it can be performed through this large opening portion, and the workability of maintenance work can be improved. Further, not only the maintenance work can be performed easily, but also the working efficiency can be improved particularly in the maintenance work of the devices arranged in front of or under the engine.

DESCRIPTION OF THE PREFERRED EMBODIMENTS

Figure 1:
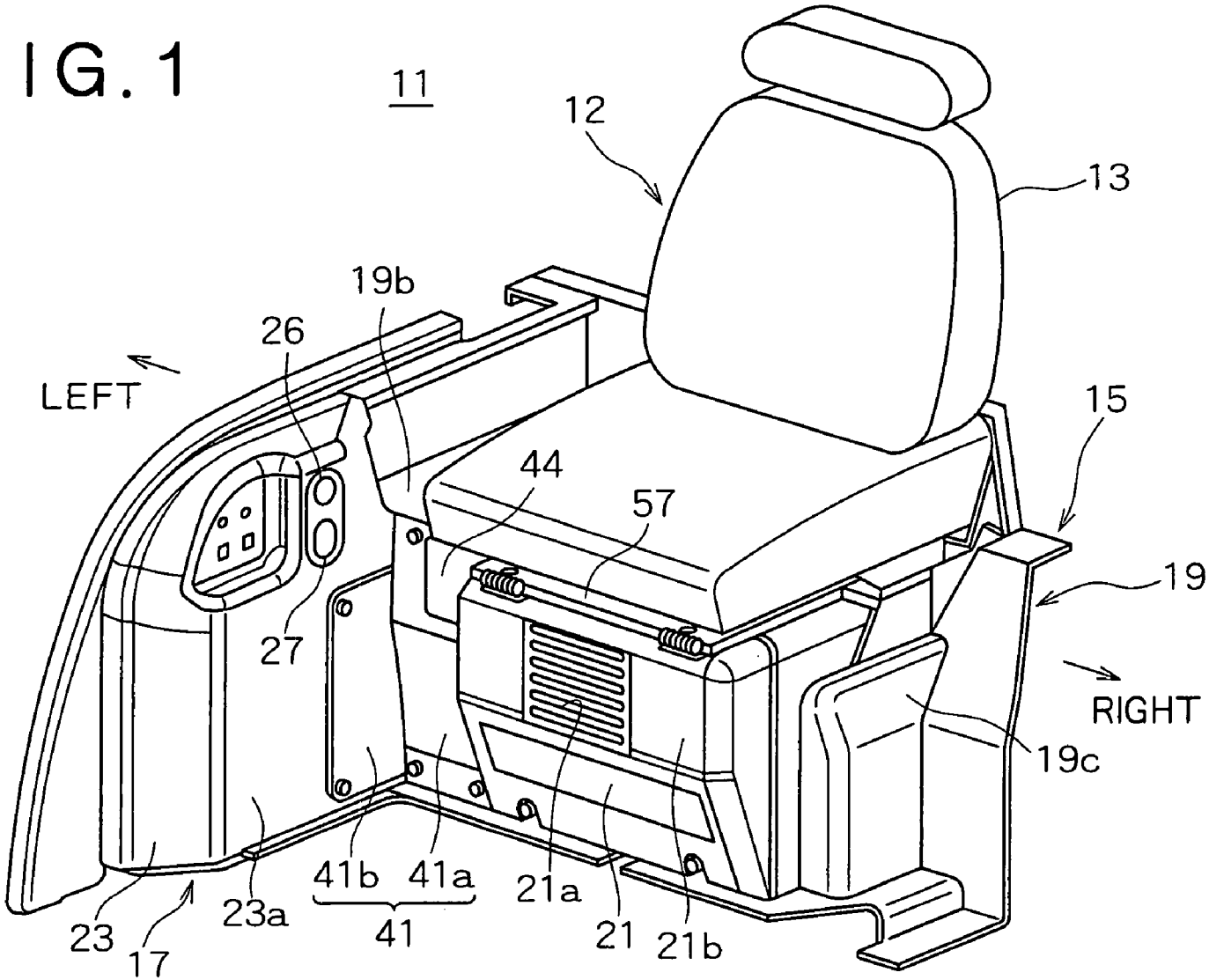
FIG. 1 is a perspective view showing an essential part of an upper rotating body in one preferred embodiment of the present invention.

The present invention is characterized by integrally forming a front shielding plate for shielding the rear of an operation space and a side shielding plate for shielding a side of the operation space, and forming a maintenance opening portion extending over between the front shielding plate and the side shielding plate.

More concretely, a construction machine according to one preferred embodiment of the present invention comprises the front shielding plate for shielding an engine and an operation space laid out in front of the engine and the side shielding plate for shielding the operation space and devices disposed on the side of the operation space, wherein the front shielding plate and the side shielding plate are integrally formed into one unit member, a maintenance opening portion is formed so as to extend over between the front shielding plate and the side shielding plate, and a maintenance cover for closing or blocking the opening portion is detachably mounted thereon.

Since the front shielding plate and the side shielding plate are integrally formed into one unit member, and the maintenance opening portion is formed extending over between the front shielding plate and side shielding plate, it is not necessarily required to provide a frame in a joint portion of the front shielding plate and side shielding plate, or the opening portion, unlike the structure of bolting a cover to each surface of a frame-shaped frame. According to this embodiment, since an obstacle such as the frame can be eliminated in the opening portion to be opened at the time of the maintenance, the workability of the maintenance work through this opening portion can be improved.

The present invention is further characterized by forming a maintenance opening portion extending over an upper shielding plate for shielding the upper part of the engine and the front shielding plate for shielding the front part of the engine, or mounting a heater on a maintenance cover for blocking the maintenance opening portion, which is formed in the upper shielding plate or front shielding plate.

More concretely, a construction machine according to another preferred embodiment of the present invention comprises the upper shielding plate for shielding the upper part of the engine, the front shielding plate for shielding the front part of the engine, the front shielding plate being connected to the upper shielding plate, the maintenance opening portion formed extending over between the upper shielding plate and the front shielding plate, and the maintenance cover for blocking the opening portion.

In this case, since the maintenance opening portion is provided so as to extend over between the upper shielding plate and the front shielding plate, the maintenance opening portion can be formed more largely in the present invention, unlike the structure having an opening only on the top plate provided above the engine. Therefore, when the maintenance work of the engine and the equipment and devices disposed around the engine can be performed through this largely formed opening portion, and the workability of the maintenance work can be improved. In the maintenance work of the devices, further, a worker is not limited to reach out the worker's hands from the upper part of the engine, but also reach out the hands from the front part of the engine. Therefore, the working efficiency can be improved particularly in the maintenance work of the equipment and devices disposed in front of or under the engine. The work performed while reaching out the hands from the upper part of the engine is the work involving an extremely heavy burden for the workers. However, since the hands can be reached out from the front part of the engine, the maintenance work can be performed easily.

The present invention will be further described in detail in reference to the embodiments shown in FIGS. 1–8.

This embodiment is an application to a hydraulic compact excavator as construction machine. This excavator comprises a lower traveling body (not shown), and an upper rotating body 11 rotatably provided on the upper part of the lower traveling body. As shown in FIG. 1, the upper rotating body 11 is provided with an operation space 12. In the operation space 12, a seat stand 15 provided in a rear section of the space 12, a seat 13 for an operator, which is supported by the seat stand 15, and a control stand 17 adjacently disposed on a side of the seat stand 15 are disposed. The equipment and devices such as tank (not shown) are disposed within the control stand 17.

In this embodiment, the control stand 17 is disposed on the deep side (the left side in FIG. 1) opposite to a platform side (the right side in FIG. 1) through which the operator gets on and off, or only on the right side of the seat stand 15. A control box including an operation lever, switches and the like (not shown) is set on the upper side in the rear of the control stand 17.

The seat stand 15 is constituted by covering a frame body (not shown) assembled in a substantially box shape with an outer wall portion (cover) 19 formed of a steel plate or the like. The outer wall portion 19 consists of an integrated product formed by integrating a front wall portion 19*a* (refer to FIG. 2), an upper surface portion 19*b*, a left wall portion 19*c* and a rear wall portion (not shown) by welding or the like. The seat stand 15 is opened on the lower surface side, and fixed to a floor plate (not shown) as the floor portion of the upper rotating body 11.

Under the seat stand 15, or in the rear of the operation space 12, the engine and the like are disposed although they are hidden by the stand. The front wall portion 19*a* of the seat stand 15 constitutes the front shielding plate for shielding the engine and the operation space 12 arranged in front of the engine.

The seat 13 and a heater cover 21 are set on the upper surface portion 19*b* and the front wall portion 19*a* of the seat stand 15, respectively. The heater cover 21 is formed substantially in the rectangular dish shape, and mounted just under the front end of the seat 13 so that the opened surface is located on the rear side. A heater (located on the inside of the cover 21 in FIG. 1 and not shown) for blowing heated air or hot air is housed in the heater cover 21. In FIG. 1, denoted at 21*a* is an outlet port of hot air.

Figure 2:
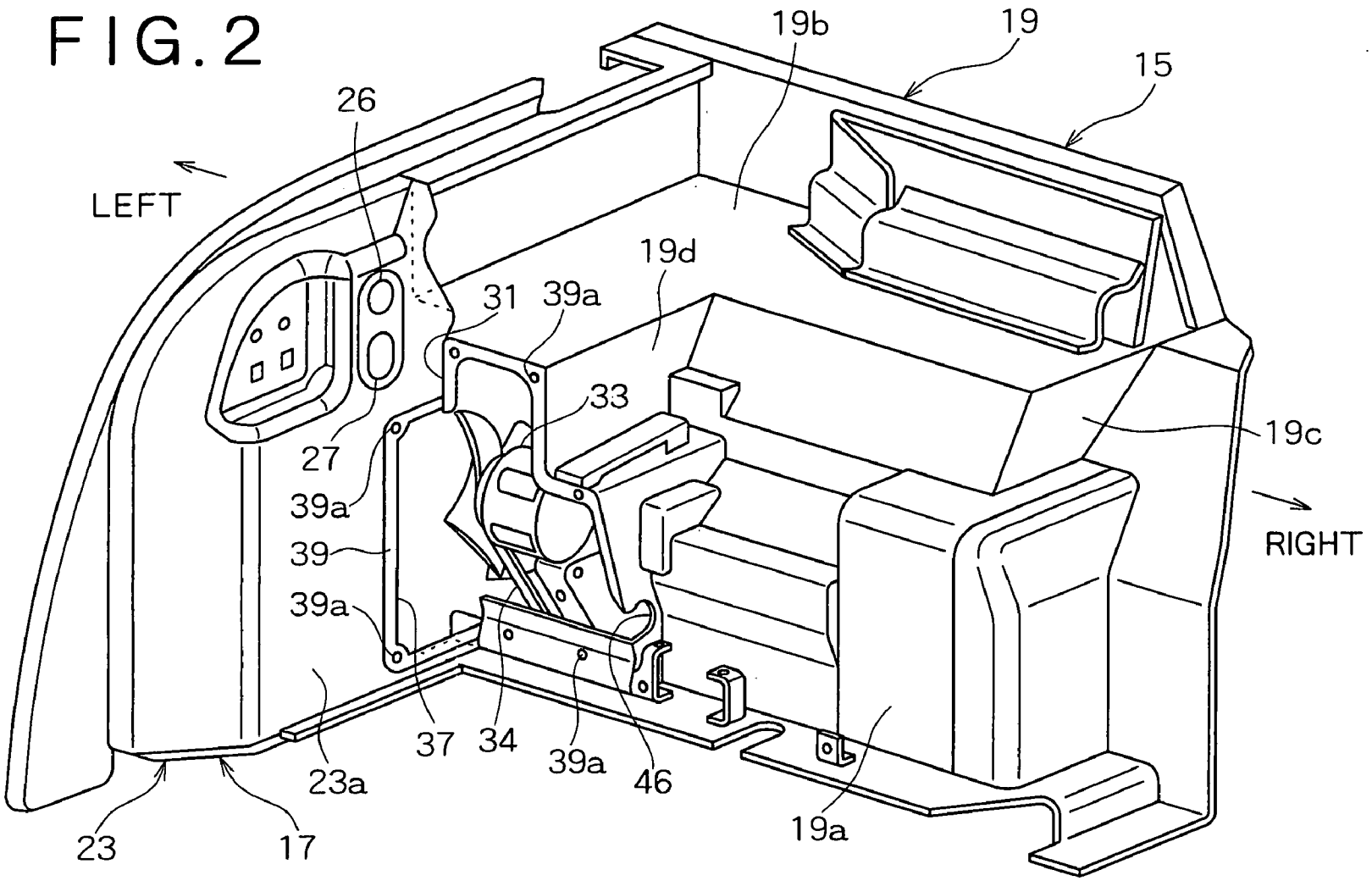
FIG. 2 is a perspective view showing a seat stand and control stand in the same embodiment where a seat, a heater cover, and a maintenance cover are removed.
Figure 3:
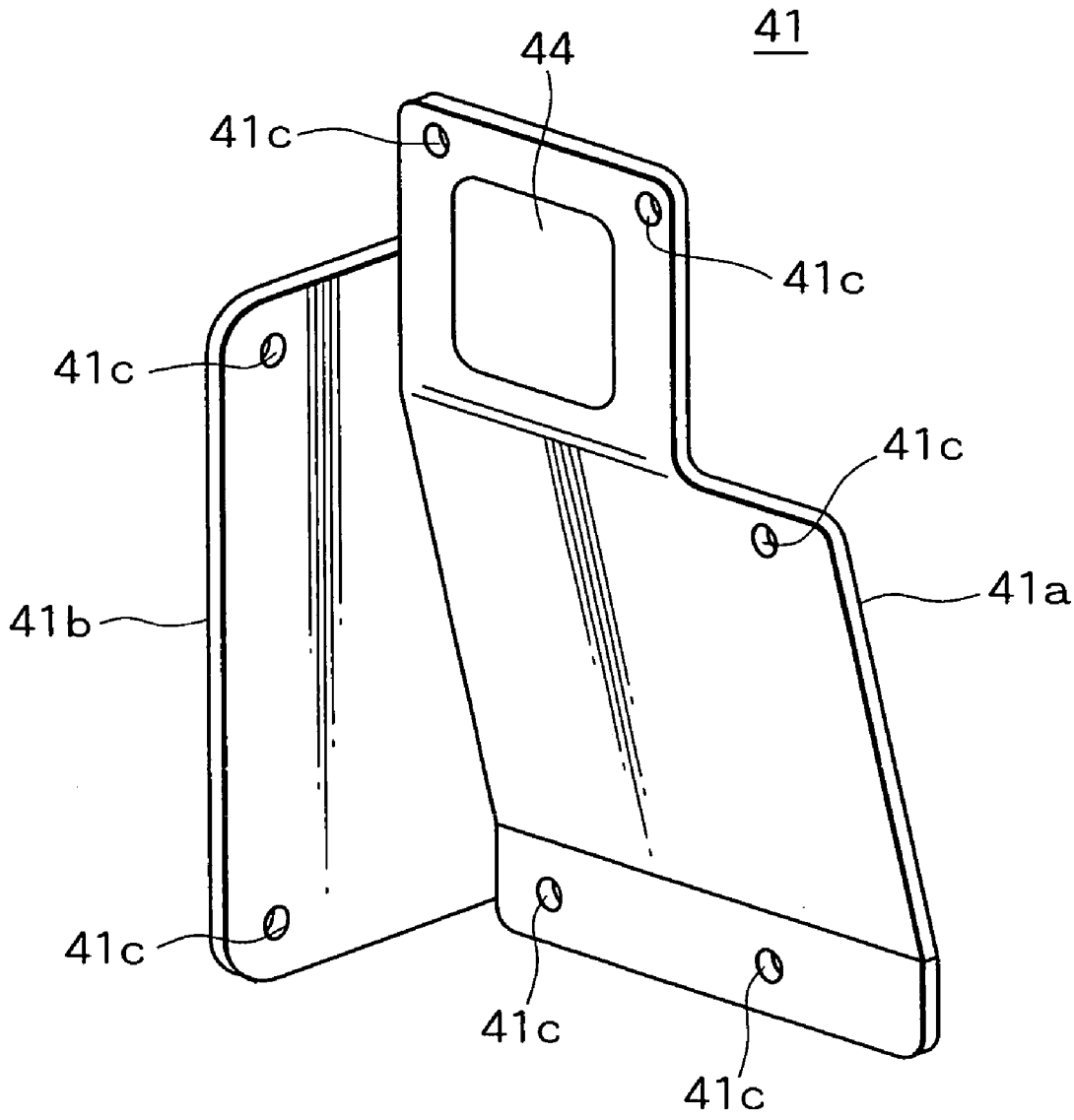
FIG. 3 is a perspective view showing the maintenance cover in the same embodiment.

As shown in FIG. 2, the seat stand 15 and the control stand 17 are integrally formed in the hook shape in a plan view.

In more detail, the control stand 17 is arranged adjacently to the right side of the seat stand 15 forward as seen from the operator, and the control stand 17 is formed in a form of swelling forward from the front wall portion 19*a* of the seat stand 15. A left side wall portion 23*a* of the control stand 17 is connected to the right end of the seat stand 15, and extended forward from this joint portion. Namely, the left side wall portion 23*a* of the control stand 17 is arranged on the side of the front wall portion 19*a* of the seat stand 15, and the left side wall portion 23*a* and the front wall portion 19*a* are integrally formed into one unit member.

The front wall portion 19*a* is a part formed below the upper surface portion 19*b* and extended in the transverse direction from the right side to the left side wall portion 23*a* in FIG. 2.

The connection of the seat stand 15 to the control stand 17 is performed by welding. This connection of welding is simply one example of integrating means, and the integration means is never limited by this. The left side wall portion 23*a* of the control stand 17 is continued to the right end of the front wall portion 19*a* of the seat stand 15. The left side wall portion 23*a* constitutes the side shielding plate for shielding the operation space 12 and the equipment and devices such as the tank arranged on the side of the operation space 12.

When the control stand 17 is provided on the other side of the drawing, the right side wall portion is constituted as the side shielding plate.

The left side wall portion 23*a* and right wall portion (not shown) constituting the outer wall part 23 of the control stand 17 are formed so as to vertically extend. On the other hand, both the wall portions are inclined on the upper side and the front side so as to mutually get close, and mutually connected at the ends. The lower surface of the control stand 17 is opened, and fixed to the floor plate.

Switches such as an hour meter 26 and a power supply socket 27 are disposed on the left side wall portion 23*a*. The hour meter 26 and the power supply socket 27 are arranged in the vicinity of the rear end of the left side wall portion 23*a*.

The inside of the seat stand 15 and the control stand 17 is formed into one large space. The above-mentioned devices and parts such as the engine and the tank are housed in this inside space. For example, the engine is mainly arranged in the seat stand 15-side space of the inside space, and the tank is mainly arranged in the control stand 17-side space. An alternator 33, a belt 34 for driving the alternator 33 and the like are disposed around the engine. FIG. 2 shows the state where they are partially seen. This alternator 33 is arranged between the engine and the front wall portion 19*a* of the seat stand 15.

The seat stand 15 has a depressed portion 19*d* depressed stepwise backward and downward from the front wall portion 19*a* and the upper surface portion 19*b*. The depressed portion 19*d* is provided in order to dispose the heater and the like under the seat 13.

A maintenance opening portion 37 is formed in the front wall portion 19*a* of the seat stand 15 and the left side wall portion 23*a* of the control stand 17 so as to extend over both the wall portions 19*a* and 23*a*. In the front wall portion 19*a*, the opening portion 37 is formed at the right end located closer to the right side (the left side in FIG. 2) of the depressed portion 19*d* forward as seen from the operator. On the other hand, in the left side wall portion 23*a*, it is formed at the rear end of the left side wall portion 23*a*. The opening portion 37 is provided near the heel of the right foot of the operator. The right side (the left side in FIG. 2) of the upper end of the opening portion 37 corresponds to a welded part 31 where the front wall portion 19*a* and the left side wall portion 23*a* are connected by welding.

The alternator 33 is arranged just inside the opening portion 37 in the seat stand 15. The tank is arranged just inside the opening portion 37 in the control stand 17.

A fixing portion 39 is provided substantially entirely over the edge of the opening portion 37. The fixing portion 39 is formed in the slender sheet shape extending in parallel to the front wall portion 19*a* or left side wall portion 23*a* and along the edge thereof with a substantially fixed width. The fixing portion 39 has a number of bolt holes 39*a* for inserting bolts. Nuts (not shown) are welded to the reverse side of the fixing portion 39 corresponding to the bolt holes 39*a*.

A maintenance cover 41 (hereinafter often abbreviated to the cover 41) is mounted, as shown in FIG. 1, on the opening portion 37. The cover 41 is formed in a shape corresponding to the opening portion 37, as shown also in FIG. 3, so that the opening portion 37 can be perfectly blocked.

The cover 41 is formed of a front surface portion 41*a* corresponding to the front wall portion 19*a* of the seat stand 15 and a side surface portion 41*b* corresponding to the left side wall portion 23*a* of the control stand 17. The front surface portion 41*a* and side surface portion 41*b* are integrated into one unit member by welding. Namely, the cover 41 is formed of one plate as a member having a shape bent so as to correspond to the opening portion 37 over between the front wall portion 19*a* and the side wall portion 23*a*, and it has an L-shaped section. The front surface portion 41*a* is formed of a substantially rectangular upper side portion, a center portion connected to the upper part with a slight inclination, and a lower portion connected to the lower end of the center portion in parallel to the upper side portion. The upper side portion is provided with an opening portion (not shown) and a fuse box cover 44 detachably mounted on this opening portion. A fuse box is provided within the seat stand 15 just inside this opening. The opening portion is provided for maintenance of the fuse box which is performed as a daily inspection. An engagement claw to be engaged with the opening portion, for example, is integrally formed on the fuse box cover 44 into one unit member, so that the fuse box cover 44 is detachable by the engagement of the engagement claw with the opening.

On the other hand, the side surface portion 41*b*, which is connected extending from the upper side portion of the front surface portion 41*a* to the lower side portion thereof, is formed in the substantially trapezoidal flat shape. The side surface portion 41*b* is provided so as to be orthogonal to the upper side portion and the lower side portion of the front surface portion 41*a*.

The maintenance cover 41 is constituted so as to be detachable by bolting. Bolt insert holes 41*c* are formed in positions corresponding to the bolt holes 39*a* of the fixing portion 39 on the periphery of the cover 41. Bolts are inserted to the bolt insert holes 41*c* to fasten the cover 41 to the fixing portion 39, whereby the cover 41 is closely fitted to the fixing portion 39 to form a seal portion.

The opening portion 37 has, as shown in FIG. 2, a cutout portion 46 for drawing out a harness (not shown). The cutout portion 46 is formed continuously with the lower end of the opening portion 37. The cutout portion 46 is formed in the depressed portion 19*d* of the front wall part 19*a* so as to dent backward from the lower end of the opening portion 37. Namely, the cutout part 46 is formed so as not to be blocked by the cover 41 even if the cover 41 is mounted. The cutout portion 46 is provided in the depressed portion 19*d*, whereby the cutout portion 46 is never exposed when the heater cover 21 is mounted. Since the cutout portion 46 is formed continuously with the opening portion 37, the cutout portion 46 for drawing out the harness from the inside of the seat stand 15 and control stand 17 can be easily provided.

The working effect of the construction machine according to this embodiment will be then described.

In the construction machine according to this embodiment, the front wall portion 19*a* of the seat stand 15 and the left side wall portion 23*a* of the control stand 17 are integrally formed into one unit member by welding, and the maintenance opening portion 37 is formed extending over the front wall portion 19*a* of the seat stand 15 and the left side wall portion 23*a* of the control stand 17. Therefore, necessity for providing the frame in the joint portion between the front wall portion 19*a* and the left side wall portion 23*a*, or in the opening portion 37 is eliminated, unlike the structure of bolting the cover to each surface of the frame-shaped frame.

Accordingly, no obstacle such as frame is present in the opening portion 37, and a periodic maintenance such as removal of the alternator 33 or replacement of the belt 34 can be extremely easily performed. Further, the workability of the maintenance work can be improved.

Particularly, when a large opening for the maintenance work of the alternator 33 as in this embodiment is required, the prevent invention is extremely effective.

In this case, the opening portion 37 is formed extending over the front wall portion 19*a* and left side wall portion 23*a*, whereby the maintenance of the alternator 33 can be extremely easily performed through the opening portion 37 in which a larger opening is ensured.

In this embodiment, the front wall portion 19*a* and the left side wall portion 23*a* are connected by welding, and the maintenance cover 41 for blocking the opening portion 37 is constructed of one plate. Therefore, unlike the structure of mounting a plurality of maintenance covers on the opening portion 37 formed in the seat stand 15 and the control stand 17, no butt part is formed in the cover 41 for closing the opening portion 37 provided extending over the mutually adjacent wall portions 19*a* and 23*a*, or no clearance is thus formed. The cover 41 is formed in a shape bent corresponding to the front wall portion 19*a* and left side wall portion 23*a*. Therefore, the opening portion 37 extending over two faces of the front wall portion 19*a* and left side wall portion 23*a* can be blocked with the one cover 41.

Namely, such as the maintenance is generally performed in a working site or construction site, and it is a troublesome work to mount covers while adjusting so as not to form a clearance in the joint of the covers. When the covers are independently mounted on each face, it is difficult to perfectly seal the joint of the covers. Since earth or sludge is easily collected in the joint, this part is often concentrically washed with water. Therefore, water is penetrated into the seat stand 15 and control stand 17 through the joint of the covers to wet the contained devices and parts.

In contrast, since the opening portion 37 extending over two faces of the front wall portion 19*a* as the front shielding plate and the left side wall portion 23*a* as the side shielding plate is closed with the one maintenance cover 41 in the present invention, no butt part of the covers is formed, or no clearance is formed between the covers.

Accordingly, after the maintenance work of the contained devices and parts is ended in the working site or construction site, the maintenance cover 41 can be extremely easily mounted so as not to form a clearance. Consequently, the contained devices and parts housed in the seat stand 15 and control stand 17 such as the alternator 33 can be prevented from being wet even if the circumference of the seat stand 15 is washed with water.

In this embodiment, the outer wall portion 19 of the seat stand 15 and the outer wall part 23 of the control stand 17 are integrally formed by welding or the like. Since the opening portion 37 is formed in the integrally formed structure, there is no space of clearance other than the opening portion 37, whereby penetration of water to the seat stand 15 and control stand 17 can be further effectively prevented.

According to this embodiment, since the cover 41 is bolted to the edge of the opening portion 37, the mounting work of the cover 41 can be extremely easily performed. The fitting face between the periphery of the cover 41 and the edge of the opening portion 37 becomes the seal portion for arresting the penetration of water. Therefore, the penetration of water to the seat stand 15 and the control stand 17 can be effectively prevented.

In this embodiment, switches such as the hour meter 26 and the power socket 27 are disposed in the vicinity of the opening portion 37 in the control stand 17. Accordingly, the maintenance of these switches can be also performed through the opening portion 37.

In this embodiment, further, an opening portion is suitably provided in the cover 41 to detachably mount the fuse box cover 44 on the opening portion. In this case, the maintenance inspection of the fuse box which is performed as daily inspection can be performed only by removing the fuse box cover 44 even if the cover 41 is not removed, and the daily inspection work can be extremely easily performed.

In this embodiment, the maintenance cover 41 is constituted not to be openable by providing a hinge, but to be fastened by bolts. Accordingly, since the cover 41 can be perfectly removed at the time of the maintenance work, the cover 41 never hinders the maintenance work.

In this embodiment, the outer wall portions 19 and 23 of the seat stand 15 and the control stand 17 are integrally formed into one unit member by welding or the like. Therefore, the number of bolt holes 39*a* can be reduced, compared with the structure of bolting the cover of each wall portion. Accordingly, the penetration of water into the seat stand 15 and control stand 17 through the bolt holes 39*a* can be prevented in washing or the like.

In this embodiment, since only a part of the front wall portion 19*a* of the seat stand 15 and the left side wall portion 23*a* of the control stand 17, or only a part required in the maintenance is opened, the maintenance work can be safely performed.

In this embodiment, the maintenance cover 41 is integrally formed by welding the seat stand 15-side front surface portion 41*a* to the control stand 17side side surface portion 41*b*. However, it may be formed by bending one sheet-like member instead.

In this embodiment, the construction machine having the control stand 17 provided on the right side of the seat stand 15 is described. However, the present invention is not limited to this and the control stand 17 may be provided on both sides of the seat stand 15. In this case, the present invention may be applied to at least one control stand 17.

Although the maintenance opening portion extending over between the front wall portion 19*a* as the front shielding plate and the left side wall portion 23*a* as the side shielding plate is formed as one example, the maintenance opening portion may be formed extending over between the front wall portion 19*a* and one of the right wall portion and the upper surface portion 19*b* as the upper shielding plate.

Another preferred embodiment will be described below.

The construction machine according to this embodiment comprises an upper shielding plate for shielding the upper part of the engine, a front shielding plate for shielding the front part of the engine, which is connected to the upper shielding plate, a maintenance opening portion formed extending over between the upper shielding plate and the front shielding plate, and a maintenance cover for closing the opening portion.

Figure 4:
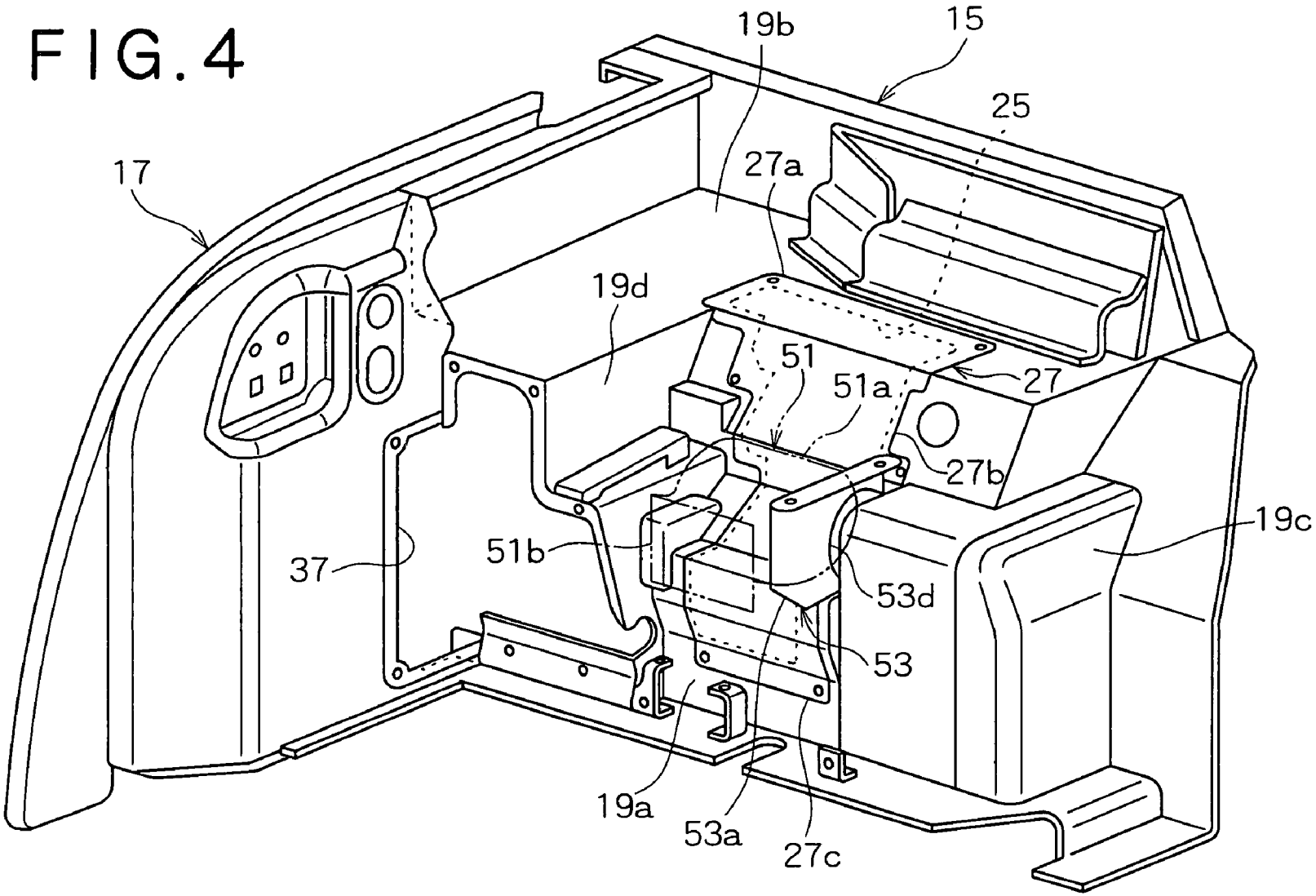
FIG. 4 is a perspective view showing the entire structure of the seat stand and control stand in another embodiment of the present invention.
Figure 5:
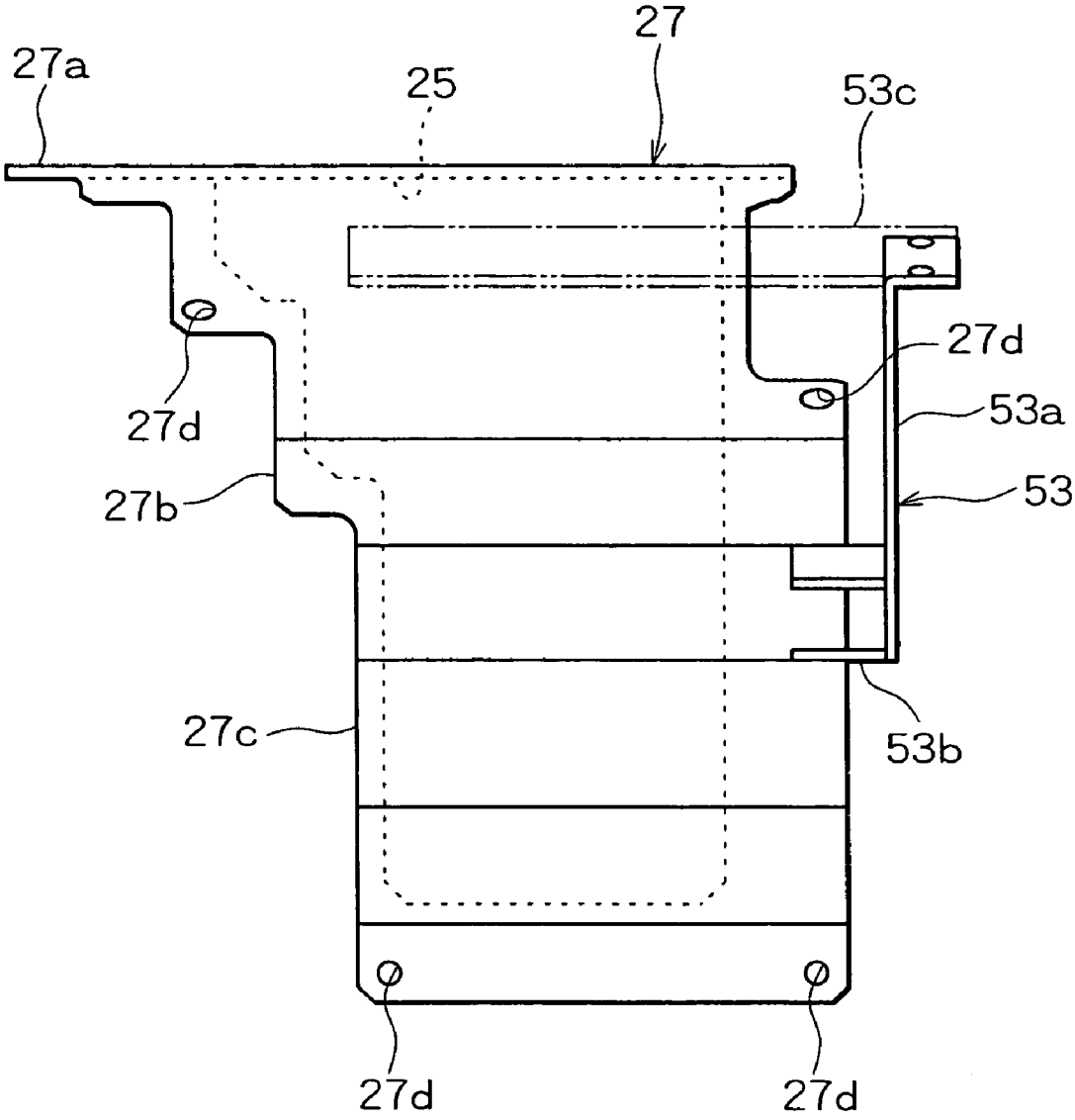
FIG. 5 is a front view showing a maintenance cover with a bracket in the same embodiment.
Figure 6:
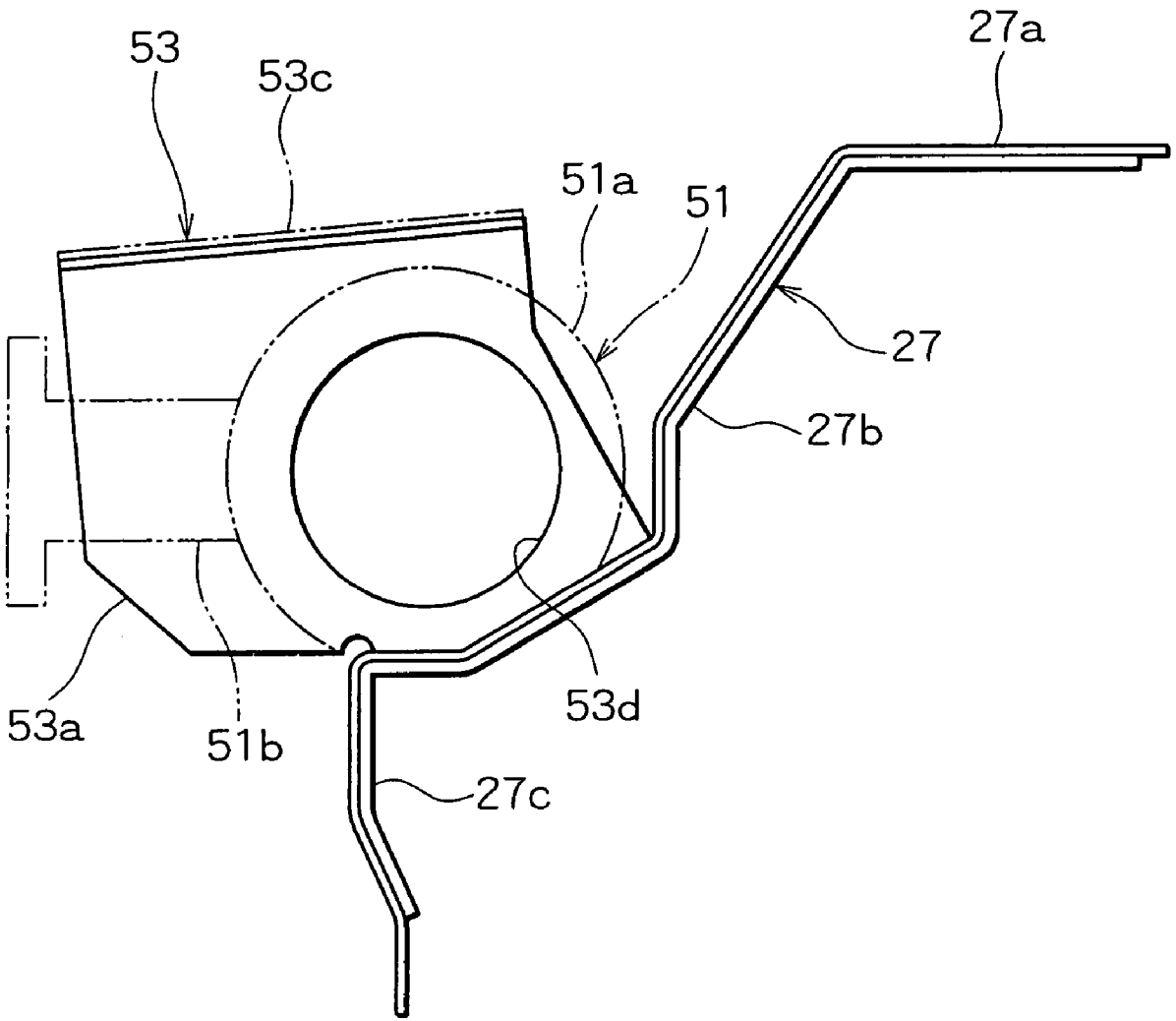
FIG. 6 is a side view showing the maintenance cover with the bracket in the same embodiment.
Figure 7:
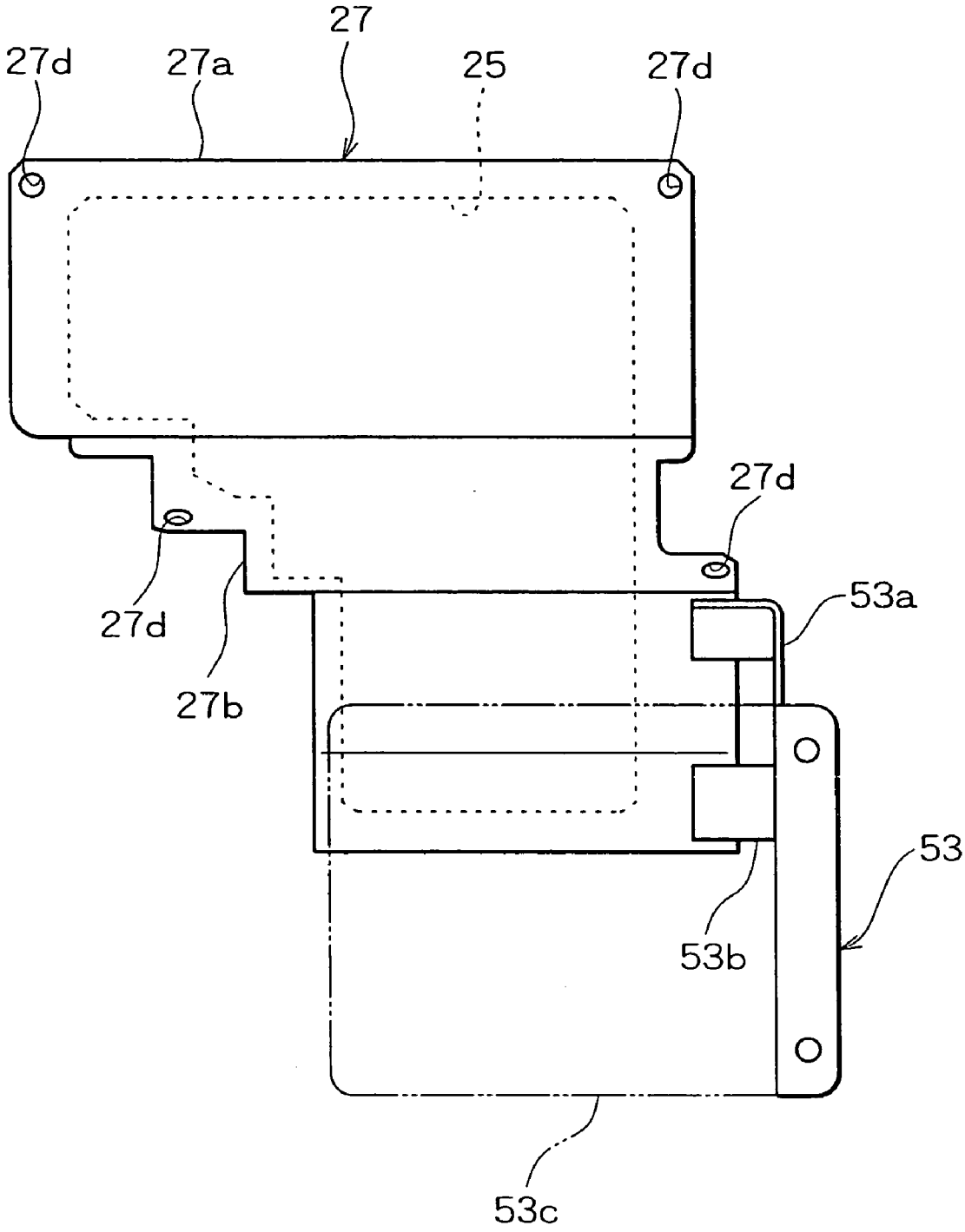
FIG. 7 is a top view showing the maintenance cover with the bracket in the same embodiment.

In FIG. 4, the layout of the engine and equipment and devices such as the tank are the same as in the above-mentioned embodiment.

The upper surface portion 19*b* of the seat stand 15 is arranged so as to extend horizontally above the engine, and the upper surface portion 19*b* constitutes the upper shielding plate for shielding the upper part of the engine. The front wall portion 19*a* of the seat stand 15 is arranged so as to extend substantially vertically in front of the engine, and the front wall portion 19*a* constitutes the front shielding plate for shielding the front part of the engine.

A seat 13 for an operator to be seated and a heater cover 21 are set on the upper surface portion 19*b* and a front wall portion 19*a* of the seat stand 15, respectively. The heater cover 21 will be described later in detail.

The seat stand 15 and the control stand 17 are, as shown in FIG. 4, integrally formed in the hook shape as seen from a plan view. Concretely, the control stand 17 is arranged adjacently to the right side of the seat stand 15 forward as seen from an operator. The control stand 17 is formed in the shape swelling forward from the front wall portion 19*a* of the seat stand 15.

A depressed portion 19*d* is formed in the lateral center of the part including the joint portion of the upper surface portion 19*b* and front wall portion 19*a* of the seat stand 15. The depressed portion 19*d* is formed so that the part including the joint portion located at the front end of the upper surface portion 19*b* lowers toward the engine, or backward and downward, and the depressed portion 19*d* is formed in the shape bent stepwise.

The connection form of the upper surface portion 19*b* to the front wall portion 19*a* is not limited. Both the portions may be integrally formed into one unit member.

The seat stand 15 has a large opening portion 25 in the lateral center portion. The opening portion 25 is formed extending from the upper surface portion 19*b* to the front wall portion 19*a* across the depressed portion 19*d*. The opening portion 25 is a maintenance opening portion, and formed in a size considering the maintenance work of the engine and the equipment and devices arranged around it.

A maintenance cover 27 (hereinafter often abbreviated to the cover 27) for closing or blocking the opening portion 25 is mounted on the opening portion 25 as shown in FIG. 4. The cover 27 is formed in the shape corresponding to the opening portion 25, as shown also in FIGS. 5–7, so that the opening portion 25 can be closely closed or blocked. Concretely, the cover 27 comprises an upper portion 27*a* corresponding to the upper surface portion 19*b* of the seat stand 15, a middle portion 27*b* connected to the lower side of the upper portion 27*a*, and a lower portion 27*c* connected to the lower side of the middle portion 27*b* and corresponding to the front wall portion 19*a*. Namely, the maintenance cover 27 is formed of one plate having a shape bent stepwise corresponding to the upper surface portion 19*b*, the depressed portion 19*d* and the front wall portion 19*a* of the seat stand 15.

The upper portion 27*a*, the middle portion 27*b* and the lower portion 27*c* of the maintenance cover 27 have bolt insert holes 27*d*, respectively. The cover 27 is detachably fastened by bolts.

The cover 27 has a heater fixing bracket 53 integrally provided as a fixing member. The bracket 53 is provided in order to fix the heater 51 blowing hot air to the operation space 12. The bracket 53 is mounted on the upper surface side (front surface side) of the middle portion 27*b* of the cover 27. The bracket 53 has a body portion 53*a* formed in a vertically extending flat shape, a leg portion 53*b* connected to the lower end of the body portion 53, and a supporting portion 53*c* connected to the upper end of the body portion 53*a*. The leg part 53*b* is horizontally extended from the lower end of the body portion 53*a* and connected at its tip to the middle portion 27*b* of the cover 27. The body portion 53*a* is bent at a substantially right angle at the upper end, and the supporting portion 53*c* is fastened to the bent portion of the body part 53*a*. The supporting portion 53*c* is formed in a substantially rectangular flat shape extending horizontally from the upper end of the body part 53*a*. The supporting portion 53*c* is constituted so as to suspend and fix the heater 51. In FIG. 4, the supporting portion 53*c* is omitted for convenience, and in FIGS. 5–7, the supporting portion 53*c* is shown by virtual lines.

The heater 51 is arranged between the supporting portion 53*c* and the cover 27. The heater 51 and the bracket 53 are disposed so as to be housed in the depressed portion 19*d* of the seat stand 15. Consequently, the heater 51 is arranged above with a predetermined space from a floor surface at the operation space 12.

The body portion 53*a* has a circularly formed opening portion 53*d*. The opening portion 53*d* is provided in order to prevent the interference of a partial part constituting the heater 51 with the bracket 53.

The heater 51 has a substantially cylindrical casing 51*a*. The casing 51*a* is connected to the engine through a hose. The heater 51 is constituted so as to heat the air by use of cooling water as a heat source by introducing the cooling water of the engine to the casing 51*a* through the hose. Namely, the heater 51 is fixed to the cover 27, and also connected to the engine through the hose. Accordingly, when the cover 27 is removed from the seat stand 15, the cover 27 can be moved within the reach of the hose. The heater 51 is shown by virtual lines in FIGS. 4 and 6 for convenience.

A blowout passage 51*b* having a substantially rectangular section is arranged on the front side of the casing 51*a*. The blowout passage 51*b* is provided on the heater cover 21 and constituted so as to send the heated air in the casing 51*a* of the heater 51 and blow out the heated air toward the operation space 12.

Figure 8:
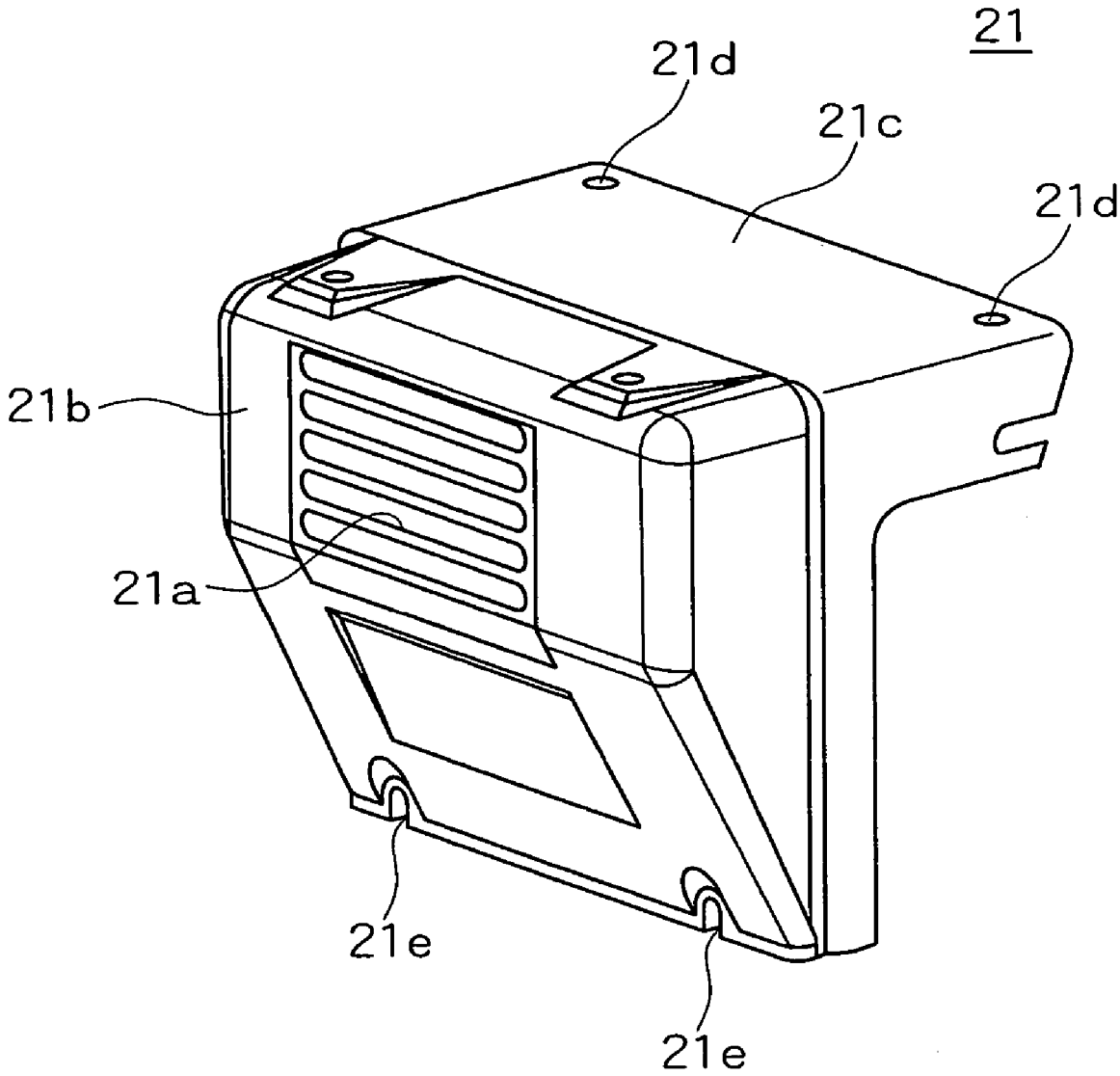
FIG. 8 is a perspective view showing the entire structure of the heater cover in the same embodiment.

The heater cover 21 is formed in a substantially rectangular bowl shape as shown in FIG. 8, and mounted on the seat stand 15 so that the opened surface is located on the rear side. The mounting of the heater cover 21 is performed, for example, by bolting (not shown). Two bolt insert holes 21*d* and two bolt inserting cutout parts 21*e* are formed at the rear end of the upper surface 21*c* of the heater cover 21 and at the lower end of the front part 21*b*, respectively. The heater cover 21 is arranged just under the front end of the seat 13, so that the upper surface portion 21*c* is located substantially flushed with the upper surface portion 19*b* of the seat stand 15.

The heater 51 is housed in the heater cover 21. The front portion 21*b* of the heater cover 21 has an outlet port 21*a* of hot air so as to communicate with the blowout passage 51*b* of the heater 51. The front portion 21*b* of the heater cover 21 is formed in a shape depressed downward over the outlet port 21*a*. Namely, the lower part of the front portion 21*b* is depressed more than the upper part having the outlet port 21*a*. Consequently, the space for arranging the heels of the operator is extended backward.

The seat 13 is mounted on the heater cover 21, as shown in FIG. 1, through a mounting plate 57. The mounting plate 57 has a hinge at the front end to be foldable into two. The mounting plate 57 is fixed to the upper surface portion 21*c* of the heater cover 21 in a folded state, and the seat 13 is fixed to the mounting plate 57 in this state. Namely, the heater cover 21 and the seat 13 are integrally provided into one unit member.

When the cover 27 is removed such as at a time of the maintenance, the seat 13 and the heater cover 21 as one unit member are taken out in an integrated state. At this time, the mounting plate 57 is first extended, whereby the seat 13 is tilted forward, and bolts for fastening the upper surface portion 21*c* of the heater cover 21 to the seat stand 15 are removed. The bolts in the front portion 21*b* of the heater cover 21 are further removed, whereby the heater cover 21 can be removed from the seat stand 15. Since the seat 13 is integrated with the heater cover 21 through the mounting plate 57, the seat 13 and the heater cover 21 are removed together as one unit member.

The bolts fixing the cover 27 are then removed, whereby the cover 27 is removed to open the opening portion 25 of the seat stand 15. At this time, the heater 51 is removed from the seat stand 15 with the cover 27. Since the heater 51 is connected to the engine through the hose, the cover 27 is movable within the reach of the hose. Therefore, when the cover 27 is to be removed during driving of the engine, the opening portion 25 can be opened without stopping the heater 51.

In this embodiment, as shown in FIG. 4, an opening portion 37 is formed so as to extend over the seat stand 15 and the control stand 17. The opening portion 37 is located near the heel of the right foot of the operator. The opening portion 37 can be used, for example, in the maintenance of the alternator arranged in front of the engine, the tank (not shown) arranged within the control stand 17 and the like. A cover 41 for closing the opening portion 37 is bolted to the opening portion 37 as shown in FIG. 1. An embodiment having no opening portion 37 is also possible.

The working effect of the construction machine according to this embodiment will be described.

In the construction machine according to this embodiment, the maintenance opening portion 25 is provided extending over between the upper surface portion 19*b* and the front wall portion 19*a* of the seat stand 15. Therefore, unlike the structure having an opening only in the top plate provided above the engine, the larger maintenance opening portion 25 can be formed largely. Therefore, the maintenance work of the engine and equipment and devices arranged around it can be performed through this large opening portion 25. Accordingly, the workability of the maintenance work can be improved. Further, in the maintenance work of the equipment and devices, the worker can reach out the hands from above the engine without limitation, and also reach out the hands from the front of the engine. Therefore, in the maintenance work of the equipment and devices arranged in front of or under the engine such as the alternator or starter, the working efficiency can be particularly improved. Further, the work performed while reaching out the hands from above the engine is a job involving an extremely heavy burden for the worker. However, since the work can be performed while reaching out the hands from the front of the engine, the maintenance work can be performed easily.

In this embodiment, the heater 51 is fixed to the maintenance cover 27 through the bracket 53. Therefore, when the cover 27 is removed, the heater 51 is also removed with the cover 27. Accordingly, the heater 51 never hinders the maintenance work performed through the opening portion 25, and the workability of the maintenance work can be further improved.

In this embodiment, the depressed portion 19*d* is provided in the seat stand 15, and the bracket 53 is provided in the portion of the maintenance cover 27 corresponding to the depressed portion 19*d*. Therefore, the heater 51 can be arranged so as not to protrude from the seat stand 15. Namely, the front portion of the seat stand 15 is depressed to effectively use the front space in front of the engine which is relatively wide in the past within the seat stand 15, and the heater 51 is disposed in the depressed portion.

Namely, since the bracket 53 as the fixing member and the heater 51 are disposed within the depressed portion 19*d* formed on the upper surface portion lob as the upper shielding plate and the front wall portion 19*a* as the front shielding plate, the bracket 53 and the heater 51 can be arranged so as not to produce from the shielding plates.

Consequently, in this embodiment, a vacant space can be effectively used, and the enlargement of the seat stand 15 can be avoided.

In this embodiment, the front part of the front wall portion 19*a* of the seat stand 15 is constituted as the operation space 12. The heater cover 21 is provided on the front side of the heater 51, and the blowout passage 51*b* and the outlet port 21*a* for blowing hot air to the operation space 12 are provided on the heater cover 21. Therefore, unlike the structure of arranging the heater on the side of the engine, a duct for sending hot air from the side of the engine to the front of the engine, or the rear of the operation space 12 is dispensed with. Further, since the heater 51 is not set on the side of the engine, a space can be ensured on the side of the engine. Accordingly, the peripheral space of the operation space 12 can be saved.

Since the hot air heated by the heater 51 arranged just behind the operation space is directly blown out to the operation space 12 without passing through the duct, the heating efficiency of the operation space 12 by the heater 51 can be improved.

In this embodiment, the heater 51 is arranged so as to be located above the floor surface of the operation space 12 (in the state floating through a support member), and the heater cover 21 is formed so that the lower part is depressed according to it. Therefore, the space at the feet of the operator in the operation space 12, particularly, the most important arrangement space of the heels can be widely ensured.

In this embodiment, since the seat 13 for the operator to be seated is integrally provided with the heater cover 21 as one unit member, the seat 13 can be removed together when the heater cover 21 is also removed. Accordingly, the seat 13 never hinders the maintenance.

The present invention may be constituted further as follows.

In the above embodiment, the maintenance opening portion 25 is formed extending over the upper surface portion 19*b* and the front wall portion 19*a* of the seat stand 15. Instead of this, the maintenance opening portion 25 may be formed only in the front wall portion 19*a* of the seat stand 15 or only in the upper surface portion 19*b*. In this case, the maintenance cover 27 is constituted to a shape corresponding to the opening portion 25, and the bracket 53 for fixing the heater 51 is mounted on the cover 27. Therefore, when the opening portion 25 is formed in the front wall portion 19*a* of the seat stand 15, the heater 51 is set on the front side of the front wall portion 19*a*. When the opening portion 25 is formed in the upper surface portion 19*b* of the seat stand 15, the hater 51 is set on the upper side of the upper surface portion 19*b*. When the heater 51 is set on the front side of the front wall portion 19*a*, a depressed part lowering backward is preferably provided in the front wall portion 19*a* to set the heater 51 in the depressed portion.

In such a structure described above, since the heater 51 is fixed to the maintenance cover 27 through the bracket 53, the heater 51 can be removed with the cover 27 when the cover 27 is also removed. Accordingly, the heater 51 never hinders the maintenance work performed through the opening portion 25, and the workability of the maintenance work can be improved.

Although the invention has been described with reference to the preferred embodiments in the attached figures, it is noted that equivalents may be employed and substitutions made herein without departing from the scope of the invention as recited in the claims.

I claim:

1. A construction machine comprising:

an upper shielding plate for shielding an upper part of an engine;

a front shielding plate for shielding a front part of said engine;

a side shielding plate for covering devices on the construction machine, the side shielding plate being disposed adjacently to said front shielding plate to generally form an L-shape having a corner which is depressed as viewed from outside the shielding plates, wherein the front and side shielding plates are integrally formed as one unit;

a maintenance opening portion being formed in said front shielding plate and said side shielding plate; and a detachable maintenance cover mountable to said front and side shielding plates for closing said maintenance opening portion.

2. The construction machine according to claim 1, wherein said front shielding plate and said upper shielding plate are connected to each other.

3. The construction machine according to claim 1, wherein said maintenance opening portion to extend over between said front shielding plate and said shielding plate is formed to be bent and said maintenance cover is formed of one unit member formed to be bent in such a manner that the one unit member corresponds to said maintenance opening portion.

4. The construction machine according to claim 1, wherein said maintenance opening portion is for maintenance of an alternator.

5. The construction machine according to claim 1, wherein said maintenance cover has an opening portion for maintenance of a fuse box, and a detachable fuse box cover for covering said opening portion.

6. The construction machine according to claim 2, further comprising a fixing member for fixing a heater, the fixing member being provided on the maintenance cover.

7. The construction machine according to claim 6, wherein said a depressed corner is formed by said upper, front and side shielding plates, said maintenance opening portion is formed in said depressed corner, and said heater is arranged in said depressed corner through said fixing member.

8. The construction machine according to claim 6, wherein an operation space for an operator is located in front of said front shielding plate, and said heater is arranged above with a predetermined space from a floor surface at said operation space.

9. A construction machine comprising:

an upper shielding plate for shielding an upper part of an engine;

a front shielding plate for shielding a front part of said engine;

a side shielding plate for covering devices on the construction machine, the side shielding plate being disposed adjacently to said front shielding plate, with a maintenance opening portion being formed so as to extend over between said front shielding plate and one of said side shielding plate and said upper shielding plate;

a detachable maintenance cover for closing said maintenance opening portion, wherein said front shielding plate and said upper shielding plate are connected to each other; and a fixing member for fixing a heater, the fixing member being provided on the maintenance cover, wherein an operation space for an operator is located in front of said front shielding plate, a heater cover is provided in front of said heater, and said heater cover has a blowout passage for blowing out heated air to said operation space.

10. The construction machine according to claim 9, wherein a seat for an operator is integrally provided on said heater cover so as to form one unit member.

11. A construction machine comprising:

an upper shielding plate for shielding an upper part of an engine;

a front shielding plate for shielding a front part of said engine, with a maintenance opening portion being formed in either said upper shielding plate or said front shielding plate;

a maintenance cover mountable to said upper and front shielding plates for closing said maintenance opening portion; and a fixing member for fixing a heater, the fixing member being provided on said maintenance cover.

12. The construction machine according to claim 11;

wherein an operation space for an operator is located in front of said front shielding plate, and said heater is arranged above with a predetermined space from a floor surface at said operation space.

* * * * *